US005754004A

United States Patent [19]

Miyagawa et al.

[11] Patent Number: 5,754,004

[45] Date of Patent: May 19, 1998

[54] GAS DISCHARGE TYPE DISPLAY DEVICE AND METHOD OF PRODUCING SAME

[75] Inventors: Utaro Miyagawa; Shinya Fujiwara, both of Kyoto, Japan

[73] Assignee: Matsushita Electronics Corporation, Japan

[21] Appl. No.: 655,857

[22] Filed: May 31, 1996

[30] Foreign Application Priority Data

Jun. 8, 1995 [JP] Japan ..... 7-141518

[51] Int. Cl.[6] ..... H01J 17/49

[52] U.S. Cl. ..... 313/585; 313/586; 315/169.4

[58] Field of Search ..... 313/484, 485, 313/582, 584, 585, 586, 587; 315/169.4; 345/60, 62

[56] References Cited

PUBLICATIONS

Patent Abstracts of Japan, Publication No. 06187915, published Jul. 8, 1994.

Patent Abstracts of Japan, Publication No. 02152138, published Jun. 12, 1990.

Patent Abstracts of Japan, Publication No. 02220329, published Sep. 3, 1990.

Patent Abstracts of Japan, Publication No. 04363092, published Dec. 15, 1992.

Patent Abstracts of Japan, Publication No. 05094772, published Apr. 16, 1993.

*Primary Examiner*—Michael Horabik
*Assistant Examiner*—Michael Day
*Attorney, Agent, or Firm*—Parkhurst & Wendel

[57] ABSTRACT

A gas discharge type display device for displaying characters and pictures by utilizing a gas discharge, and a method of producing the same. This gas discharge type display device includes first and second base plates held together in a mutually opposed and closed state, with a rare gas sealed in the closed region; first electrode wires embedded in the first base plate; second electrode wires disposed in the second base plate; display electrode bodies electrically connected to the second electrode wires; a first partition wall which is formed between the first and second base plates to surround said display electrode bodies, whereby it is capable of forming discharge cells and also auxiliary discharge cells capable of feeding priming fire to the discharge cells; a second partition wall joined at one end surface thereof to the first base plate and at the other end surface to the end surface of the first partition wall; and a notch formed in the second partition wall to allow the discharge cells and the auxiliary discharge cells to communicate with each other.

3 Claims, 2 Drawing Sheets

GAS DISCHARGE TYPE DISPLAY DEVICE AND METHOD OF PRODUCING SAME

FIELD OF THE INVENTION

The present invention relates to a gas discharge type display device for displaying characters and/or pictures by utilizing gas discharge, and a method of producing the same.

BACKGROUND OF THE INVENTION

In recent years, size of the television sets has increased to a considerable extent such that projection type television sets using projection cathode ray tubes or liquid crystal panels have been marketed. However, known projection type television sets and liquid crystal panels still have problems with respect to brightness of the screen and the size of the set.

In contrast, gas discharge type display devices, such as plasma display panels, are utilized as planar type display devices in information terminals, such as portable computers. These kinds of gas discharge type display devices are experiencing larger fields of applications due to their sharp display and greater angle of visibility compared to that provided by liquid crystal panels.

Further, the plasma display panel, which has recently attained advances in coloring techniques, is being spotlighted as a display device whose depth can be radically reduced to take the place of color image tubes. Therefore plasma display is becoming the most promising technology for use in hang-on-wall hi-vision television sets, and are expected to provide improvements in fidelity color reproduction, brightness and service life.

A known common plasma display panel comprises a first electrode formed on a face plate, a second electrode formed on a back plate, said first and second electrodes being opposed and orthogonal to each other with a partition wall disposed therebetween, said partition wall being formed on said back plate, and discharge cells formed at the intersections between said electrodes. Further, a number of discharge cells are arranged in a matrix pattern and the face and back plates are combined, with their peripheries sealed with for example, a low melting glass, and a discharge gas is sealed therein which consists mainly of a rare gas.

Further, auxiliary discharge cells are formed along the discharge cells separated by the partition wall, whose upper surface is provided with a priming slit for allowing the discharge cells to communicate with the auxiliary discharge cells. This priming slit is formed by locally notching a priming rib formed on the end surface of the partition wall. Upon firing of the discharge cells, priming fire is drawn from the auxiliary discharge cells through said priming slit, thereby lowering the discharge start voltage. This priming slit, which serves as a slit for drawing priming fire into the discharge cells, also serves as a space for receiving the first electrode formed on the face plate in order to decrease the gap formed between the upper part of the priming rib and the face plate.

With such known arrangement, however, the first electrode formed on the face plate has to be fitted in the priming slit formed in the back plate, posing a problem that high accuracy is required in the shape, position, repetition pitch and positioning of the priming slit and first electrode. If the allowance for fit is increased to solve this problem, a new problem will arise that the priming fire discharge leaks through the resulting clearance thereby causing an erroneous discharge.

DISCLOSURE OF THE INVENTION

The present invention, which has overcome the problems of the prior art discussed above, has for its object the provision of a gas discharge type display device and a method of producing the same, characterized by an increased allowance for precision in processing and positioning the partition wall and priming rib as compared with the known construction, the absence of the danger of causing an erroneous discharge between adjoining discharge cells, and capability of realizing a large-sized display device.

To achieve this object, a gas discharge type display device according to the present invention comprises first and second base plates held together in a mutually opposed and closed state, with a rare gas sealed in the closed region; first electrode wires embedded in the first base plate; second electrode wires disposed in the second base plate; display electrode bodies electrically connected to said second electrode wires; a first partition wall which is formed between said first and second base plates to surround said display electrode bodies, whereby it is capable of forming discharge cells and also auxiliary discharge cells capable of feeding priming fire to said discharge cells; a second partition wall joined at one end surface thereof to the first base plate and at the other end surface to the end surface of the first partition wall; and a notch formed in said second partition wall to allow said discharge cells and said auxiliary discharge cells to communicate with each other.

Further, a method of producing a gas discharge type display device according to the invention comprises the steps of preparing first and second base plates; disposing first electrode wires in the first base plate; disposing second electrode wires in the second base plate, with display electrode bodies electrically connected to said second electrode wires; forming a first partition wall on the second base plate, said first partition wall defining a first space which surrounds the display electrode body and a second space which is different from said first space; forming a second partition wall on the first base plate, with a notch formed in and extending through said second partition wall; placing said first and second base plates in mutually opposed relation and joining the end surfaces of the first and second partition walls to each other, thereby forming discharge cells surrounding said display electrode bodies and auxiliary discharge cells which are capable of feeding priming fire to said discharge cells through notches; and sealing the opposed first and second base plates around their peripheries, with a rare gas filled in the sealed space therein.

Therefore, according to the invention, the second rib, i.e., the priming rib having a notch is formed on the first base plate having the first electrode wires embedded therein, said notch serving as a priming slit; thus, the preciseness concerning the shape and size of the priming slit can be easily obtained, and the allowance for preciseness in processing and positioning the first partition wall and priming rib is sufficient and hence a large-sized display device can be easily realized.

Further, in the aspect of production, since there is no need for the first electrode wires disposed on the first base plate to be fitted in the slits in the top of the partition wall, the allowance for the preciseness with which the parts are processed is increased as compared with the known art, and the positioning of the first and second base plates is facilitated when the first and second plates are stuck together. Therefore, even a large-sized panel suffers little variation in discharge start voltage in the panel plane and hence a large-sized display device can be easily realized.

According to the invention, the formation of the notches at positions where they do not overlap the first electrode wires prevents an erroneous discharge from taking place between adjoining discharge cells. Thus, a large-sized display device can be easily realized.

DESCRIPTION OF THE EMBODIMENTS

Figure 1:
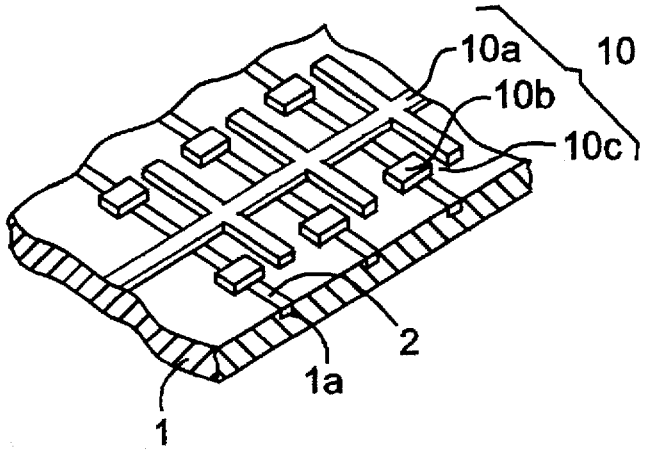
FIG. 1 is a perspective view showing the arrangement of the front plate of a plasma display panel serving as a gas discharge type display device according to the present invention.
Figure 2:
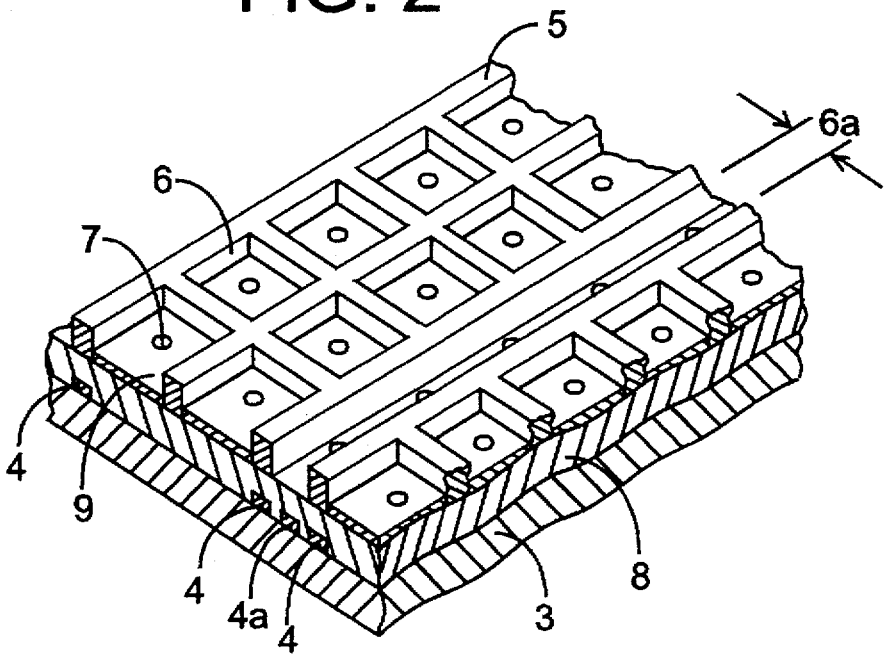
FIG. 2 is a perspective view showing the arrangement of the back plate of said plasma display panel.
Figure 3:
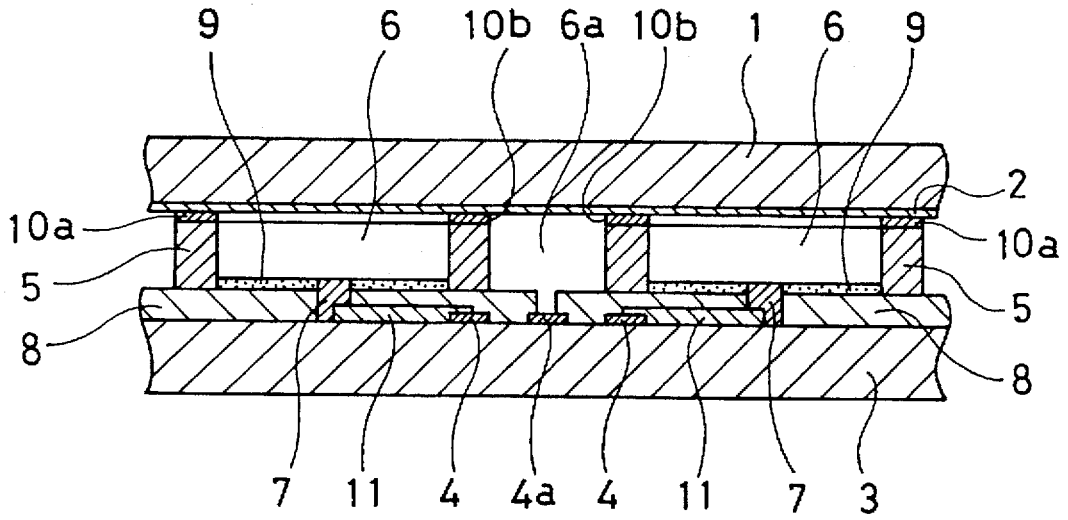
FIG. 3 is a sectional view of said plasma display panel.

As shown in FIGS. 1 through 3, the surface of a face plate 1 is formed with a number of parallel grooves la spaced from each other, with a first electrode wire 2 fitted in each groove 1*a*. It is desirable that the surface of the first electrode wire 2 be flush with the surface of the first base plate 1.

The surface of a back plate 3 is provided, as by the thick film printing method, with a number of second electrode wires 4 spaced from each other. Further, the surface of the back plate 3 is provided with auxiliary electrode wires 4a, display electrode bodies 7, resistors 11 connecting the second electrode wires 4 to the display electrode bodies 7, and a dielectric layer 8 for protecting the second electrode wires 4 and the like. The surface of the dielectric layer 8 is formed with a partition wall 5 of square matrix pattern.

These face and back plates 1 and 3 are combined, whereby the first and second electrodes 2 and 4 are disposed in orthogonal and opposed relation to each other with the partition wall 5 interposed therebetween. Discharge cells 6 in the form of cubic spaces separated by the partition wall 5 are formed in the vicinity of the intersections between the first and second electrode wires 2 and 4. As a result, a number of discharge cells 6 are arranged in a matrix pattern. The display electrode bodies 7 are respectively surrounded by the partition wall 5, whereby they are disposed inside the discharge cells 6. The combined face and back plates 1 and 3 have their peripheries sealed by, for example, low melting glass, and a discharge gas consisting mainly of a rare gas is sealed therein.

The regions of the surface of the dielectric layer 8 in the discharge cells 6 excluding the display electrode bodies 7 are formed with fluorescent layers 9. The end surfaces of the display electrode bodies 7 are exposed to the interiors of the discharge cells 6. An auxiliary discharge cell 6*a* is formed along the discharge cells 6 separated by the partition wall 5. Auxiliary electrode wires 4*a* are formed in opposed relation to said auxiliary discharge cell 6*a*.

The surface of the first base plate 1 is provided with a priming rib 10 serving as a second partition wall. This priming rib 10 is constructed such that when the face and back plates 1 and 3 are combined as described above, the priming rib 10 is joined to the front end surface of the partition wall 5. And the planar shape of this priming rib 10 comprises a region 10*a* (hereinafter referred to as "main rib") surrounding the respective three sides of the rectangular discharge cells 6 as seen in plan view and regions (hereinafter referred to as "sub-rib") 10*b* formed on the respective remaining one side. The sub-ribs 10*b* are formed on the first electrode wires 2. Each sub-rib 10*b* is formed with a slit 10*c* by locally notching the sub-rib 10*b*. The slit 10*c* is formed between the opposite ends of the sub-rib 10*b*, i.e., between the main rib 10*a* and the sub rib 10*b* and constitutes a priming slit when the face and back plates 1 and 3 are stuck together in mutually opposed relation as described above.

The face and back plates 1 and 3 are opposed to each other and stuck together so that the end of the priming rib 10 contacts the end of the partition wall 5, and a rare gas is filled in the interior, thereby providing a gas discharge type display device according to the invention.

With such arrangement, since the priming rib 10 and the partition wall 5 are sealed together, with their ends almost contacting each other, the individual discharge cells 6 are independent of each other and hence an erroneous discharge is prevented. Further, since the shape of the priming slit 10*c* for drawing priming fire into the discharge cells 6 can be made uniform over the entire surface of the face plate 1, differences in the discharge start voltage between locations are reduced. Further, since the sub-ribs 10*b* of the priming rib 10 are formed on the first electrode wires 2, an erroneous discharge can be prevented. The reason is that if the first electrode wires 2 are left naked, the priming fire would be drawn along the first electrode wires 2 into those discharge cells 6 which should not emit light; however, such drawing of priming fire is prevented. Further, an erroneous discharge due to leakage of priming fire between adjoining discharge cells 6 can also be prevented.

FIG. 1 shows an example in which priming slits 10*c* are formed at two places, the opposite ends of the sub-rib 10*b*. However, one of them may be formed closed or asymmetrical in shape.

Both the priming rib 10 and the partition wall 5 may be provided on either the face plate 1 or the back plate 3.

In the arrangement of the illustrated embodiment, the face plate 1 is provided with the priming rib 10 and the back plate 3 is provided with the partition wall 3; however, this arrangement may be reversed such that the face plate 1 is provided with the partition wall 5 and the back plate is provided with the priming rib 10.

An embodiment of the method of forming a gas discharge type display device according to the invention will now be described with reference to the drawings.

First in processing the face plate 1, a photosensitive resin film is formed on the front plate 1 and a masked exposure is applied thereto, which is then developed, whereupon, with the resulting photosensitive resin film pattern used as a mask, the grooves la are formed by the sand blast method. Then, an electrically conductive paste is filled in the grooves 1*a*. A normal thick film printing method can be utilized for the filling. The screen mask to be used may be such that the electrically conductive paste permeates through the entire surface. After filling, the electrically conductive paste is dried and fired, thereby providing the face plate 1.

Then, a vehicle consisting of an organic starch is added to the low melting glass frit for mixing, and the resulting low melting glass paste is screen-printed, dried and fired, thereby forming the priming rib 10.

In the known production method previously described, since the electrodes raised on the base plate, the priming rib is sometimes distorted at the portions crossing the electrodes. According to the invention, however, since the first electrodes 2 are fitted in the grooves 1*a* formed on the face plate 1, such problem is mitigated.

In processing the back plate 3, electrically conductive paste is screen-printed on the back plate 3 using the thick film printing method, and then dried, fired, thereby forming the second and auxiliary electrode wires 4 and 4*a*. Subsequently, a resistor paste consisting mainly of ruthenium oxide is printed, dried and fired, thereby forming resistors 11. Then, a glass paste obtained by adding a vehicle consisting of an organic starch to low melting glass frit for mixing is printed on the entire surface except the portions forming the display electrode bodies 7, said glass paste being dried and fired, thereby forming the dielectric layer 8. The electrically conductive paste is filled into the holes in the dielectric layer 8, thereby forming the display electrode bodies 7.

Then, the low melting glass paste for forming partition wall is printed on the entire surface, and dried, whereupon a photosensitive resin film is formed on the entire surface. A photomask for forming a partition wall is exposed, and then developed, whereupon the photosensitive resin film is left in the partition wall forming region. In this state, sand blasting is applied, followed by firing, thus forming the partition wall 5. Thereafter, a predetermined fluorescent layer 9 is formed in the interior of the discharge cells 6, thus providing the back plate 3.

The face and back plates 1 and 3 thus obtained are joined together with their electrodes opposed to each other, and are sealed around their peripheries by a low melting glass, the interior being evacuated and filled with a rare gas to serve as a discharge gas, thus completing a discharge gas type display device.

In the above embodiment, in forming the priming rib 10, screen thick-film printing is effected using a low melting glass paste, followed by drying and firing; however, there is another method of forming a priming rib 10 which comprises printing on the entire surface a photosensitive low melting glass paste composed of low melting glass frit and a photosensitive resin, drying, exposing using a photomask, developing and firing the same. There is yet another method of forming a priming rib 10 which comprises sticking a sheet material having photosensitivity and consisting mainly of low melting glass, exposing using photomask, developing and firing the same.

As described above, in the production method of the present invention, when the face and back plates 1 and 3 are positioned together, it is only necessary to place the priming rib 10 formed on the face plate 1 and the partition wall 5 formed on the back plate 3 in end-to-end opposed relation. Therefore, there is no need, unlike the known production method, to fit the convex electrodes formed on the face plate in the grooves formed in the end surface of the partition wall of the back plate accordingly. The degree of allowance for precision of positioning is greatly improved.

What is claimed is:

1. A gas discharge type display devices comprising:

first and second base plates held together in a mutually opposed and closed state, with a rare gas sealed in a closed region defined thereby, first electrode wires embedded in the first base plate, second electrode wires and auxiliary electrode wires disposed in the second base plate, display electrode bodies electrically connected to said second electrode wires, a first partition wall disposed between said first and second base plates to surround said display electrode bodies, said first partition wall forming discharge cells and auxiliary discharge cells for feeding priming fire to said discharge cells, said auxiliary discharge cells communicating with said auxiliary electrode wires, a second partition wall joined at one end surface thereof to the first base plate and at the other end surface thereof to an end surface of the first partition wall, a notch formed in said second partition wall to allow said discharge cells and said auxiliary discharge cells to communicate with each other, said first electrode wires being directly exposed to said discharge cells and said auxiliary discharge cells, and said second partition wall having a portion disposed on said first electrode wires between each of said discharge cells and auxiliary discharge cells.

2. A gas discharge type display device as set forth in claim 1, wherein the notch is formed at a position where said notch does not overlap the first electrode wire.

3. A gas discharge type display device as set forth in claim 1, wherein the first base plate comprises grooves, in which the first electrode wires are embedded.

* * * * *